US005622363A

United States Patent [19]

Beaudreau et al.

[11] Patent Number: 5,622,363

[45] Date of Patent: Apr. 22, 1997

[54] SHEET FEEDER SYSTEM AND METHOD

[75] Inventors: Cherilyn M. Beaudreau, Satellite beach; David C. Bailey, Cocoa Beach; Jon E. Holmes, West Melbourne; Richard K. Krebs, Jr., Melbourne; Roland D. McCollum; William I. Stewart, both of Indialantic, all of Fla.

[73] Assignee: Harris Corporation, Melbourne, Fla.

[21] Appl. No.: 346,262

[22] Filed: Nov. 23, 1994

[51] Int. Cl.[6] ..... B65H 3/52; B65H 7/12

[52] U.S. Cl. ..... 271/110; 271/122; 271/263; 271/902

[58] Field of Search ..... 271/110, 121, 271/122, 188, 262, 263, 265.04, 272, 902

[56] References Cited

U.S. PATENT DOCUMENTS

| | | | |
|---|---|---|---|
| 3,857,559 | 12/1974 | McInerny | 271/122 |
| 4,494,747 | 1/1985 | Graef et al. | 271/122 X |
| 4,928,951 | 5/1990 | Fukui | 271/122 X |
| 5,029,837 | 7/1991 | Uchiyama | 271/110 |
| 5,052,836 | 10/1991 | Genno | 271/122 X |
| 5,172,899 | 12/1992 | Tajims | 271/122 |
| 5,316,284 | 5/1994 | Bolognese et al. | 271/121 |
| 5,435,538 | 7/1995 | Billings et al. | 271/122 X |

OTHER PUBLICATIONS

Abbiate et al., "Document Autofeed Mechanism and Multifeed Detection", IBM Technical Disclosure Bulletin, vol. 22 No. 11, Apr. 1980.

*Primary Examiner*—Karen B. Merritt
*Assistant Examiner*—Scott L. Lowe
*Attorney, Agent, or Firm*—Rogers & Killeen

[57] ABSTRACT

A sheet feeder may include a feed roller for compelling a sheet from a stack of sheets into a sheet path and a pair of separation rollers rotating in the same direction for urging sheets along the sheet path. The separation rollers may be selectively and separately disengaged from their motive source in coordination with operation of a motor for the feed roller to provide multiple checks for sheet multifeeds. At each check, extra sheets are returned to the stack of sheets.

32 Claims, 8 Drawing Sheets

SHEET FEEDER SYSTEM AND METHOD

BACKGROUND OF THE INVENTION

The present invention relates to sheet feeders, and more particularly to methods and systems for feeding film sheets from a stack of film sheets in which multisheet feeding is avoided.

Sheet feeders desirably provide individual sheets one at a time from a stack of sheets into a sheet path on which the sheets are conveyed to an operating stage, such as an imaging device. The term "sheet" as used herein refers to a relatively thin, flat, and generally rectangular flexible piece, including without limitation, photosensitive material (e.g., photographic film, X-ray film), paper, transparencies, foil, and the like.

The problems with sheet feeders are well known, and multisheet and misaligned sheet feeding are among the more common and particularly troublesome problems. These problems are even more troublesome when the sheets are expensive and multisheet and misaligned feeds waste sheets that cannot be reused. For example, the sheets may be photosensitive material that may be exposed after removal from the sheet feeder. If the sheets cannot be recovered and returned to the stack of sheets without inadvertent exposure, they will be rendered unusable.

The sheet feeder art is replete with attempts to solve the multisheet and/or misaligned sheet feed problems. However, these attempts have focused on rapidly feeding inexpensive sheets (such as paper) and have misfeed rates that would not be acceptable for more expensive sheets, such as X-ray film. Further, the prior art attempts do not attempt to recover a misfed sheet and return it to the stack of sheets once it has been removed from stack of sheets.

The complexity of the multisheet feed problem is increased when there is a relatively high coefficient of friction between sheets. That is, it is more difficult to separate the sheets when they do not slide easily across the top of a stack of the sheets. This problem is particularly acute with photosensitive materials that are likely to have multiple coatings on both sides of the sheet.

Accordingly, it is an object of the present invention to provide a novel sheet feeder and method with reasonable misfeed and sheet recovery rates that obviates the problems of the prior art.

It is another object of the present invention to provide a novel sheet feeder and method in which a pair of sheet separation rollers are operated in conjunction with a feed roller to check multiple times that separate sheets are being urged along a sheet path before the sheets leave the sheet feeder.

It is yet another object of the present invention to provide a novel sheet feeder and method in which a pair of sheet separation rollers are operated in conjunction with a feed roller to return misfed sheets to the stack of sheets.

It is still another object of the present invention to provide a novel sheet feeder and method in which a pair of sheet separation rollers are operated in conjunction with a feed roller, the first separation roller for urging a sheet in contact therewith forwardly along the sheet path and the second separation roller for urging a sheet in contact therewith backward to the stack of sheets.

It is also another object of the present invention to provide a novel sheet feeder and method in which a feed roller rotates backwards and a separation roller is disengaged from its drive motor to return a sheet in contact with the separation roller to the top of the stack of sheets in the event more than one sheet is compelled into the sheet path by the feed roller.

It is an additional object of the present invention to provide a novel sheet feeder and method in which a feed roller rotates backwards and two separation rollers are successively disengaged from their drive motor to return sheets inadvertently urged along the sheet path by the separation rollers to the stack of sheets.

It is a further object of the present invention to provide a novel sheet feeder and method in which a thickness sensor measures the combined thickness of sheets urged along the sheet path to determine whether more than one sheet has been so urged, and in which a first switch indicates that at least one sheet has been urged along the sheet path and a second switch indicates that more than one sheet has been urged along the sheet path, the two switches being used to trigger separate multisheet recovery operations.

It is yet a further object of the present invention to provide a novel sheet feeder and method in which a stack of sheets is provided in a cassette that is selectively inserted into the sheet feeder, and in which a cam engages the cassette to lift a weighted feed roller out of the way while the cassette is being inserted.

It is still a further object of the present invention to provide a novel sheet feeder and method in which a first separation roller provides a coefficient of friction with a sheet that is greater than a coefficient of friction between sheets, and a second separation roller provides a coefficient of friction with a sheet that is greater than the coefficient of friction between the first separation roller and a sheet, and in which the two separation rollers rotate in the same direction to urge a sheet along the sheet path and are successively released to be free wheeling during multifeed clear operations.

These and many other objects and advantages of the present invention will be readily apparent to one skilled in the art to which the invention pertains from a perusal of the claims, the appended drawings, and the following detailed description of the preferred embodiments.

DESCRIPTION OF PREFERRED EMBODIMENTS

Figure 1:
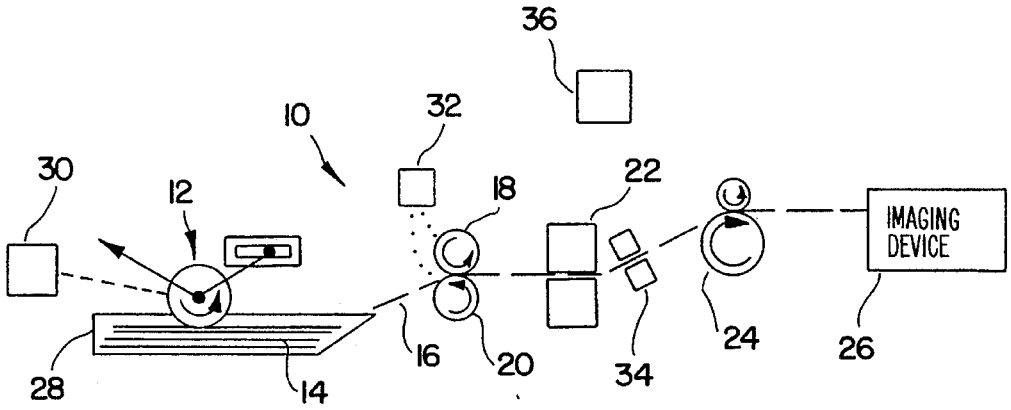
FIG. 1 is a schematic diagram of an embodiment of the sheet feeder disclosed herein.

With reference now to FIG. 1, an embodiment 10 of the sheet feeder system and method set forth herein may include a feed roller 12 that forms a nip with a sheet at the top of a stack of sheets 14, and that frictionally compels the sheet into a sheet path 16 (shown in dashed lines) when the feed roller 12 is rotated in the direction indicated by the arrow. The sheets compelled into the sheet path 16 by the feed roller 12 are routed between two separation rollers 18 and 20 that are rotated in the same direction as indicated by the arrows. The top separation roller 18 urges the sheets in contact therewith forward along the sheet path 16 (to the right in FIG. 1) to a sensor 22 that determines whether more than one sheet has been urged forward. The bottom separation roller 20 urges the sheets in contact therewith back to the stack of sheets 14. Sheets urged forward along the sheet path 16 proceed to a capstan roller 24 that assists in aligning the sheets so that they are in proper registration for an operating stage, such as an imaging device 26.

The sheets may be stacked in a removable cassette 28. The feed roller 12 may be rotated by a motor 30 that is reversible and that can stop rotation of the feed roller. The feed roller 12 may also be pivoted so that it may continue to form a nip with the top sheet as the size of the stack of sheets diminishes. The separation rollers 18 and 20 both may be operated by a motor 32 that need not be reversible. The motors 30 and 32 may be selectively disengaged from their respective rollers. A sheet trailing edge indicator 34, such as a light sensor, may be provided. Operation of the device may be controlled with a processor 36.

In normal operation, one sheet at a time proceeds from the stack of sheets 14, along the sheet path 16 to the operating stage. The motor 30 rotates the feed roller 12 in the direction indicated by the arrow to compel sheets into the sheet path, stops rotation to stop sheets from being compelled forward, and reverses rotation to recover extra sheets inadvertently compelled forward (as discussed below). The motor 32 may be rotated in one direction whenever the sheet feeder is operating and the separation rollers 18 and 20 may be selectively and separately disengaged from motor 32 to operate the sheet feeder (as discussed below). However, sheets may stick together and the feed roller 12 may inadvertently compel two sheets from the stack of sheets 14 to the separation rollers 18 and 20. The two sheets may be shingled (with staggered leading edges) or paired (with leading edges reaching the separation rollers at the same time.)

The separation rollers 18 and 20 provide a first multifeed check by frictionally urging a second sheet back toward the stack of sheets 14. The top separation roller 18 urges the sheet in contact with the top roller 18 forward along the sheet path (to the right in FIG. 1), and the bottom separation roller 20 urges the sheet in contact with the bottom roller 20 back to the stack of sheets 14 (to the left in FIG. 1). When two sheets are compelled (shingled or paired) to the separation rollers, the top sheet is urged along the sheet path and the bottom sheet is urged back. The sheet(s) urged forward by the separation roller 18 proceed to the sensor 22 that determines whether a single sheet is being urged along the sheet path. If a single sheet is being so urged, the sensor 22 provides a signal for disengaging the bottom separation roller 20 from its motor 32 (thereby allowing it to turn freely-free wheeling) so that the bottom roller 20 no longer urges the sheet backwards. The sensor 22 may also provide a signal to stop the motor 30 (desirably the same signal as used to stop motor 32) so that additional sheets are not compelled into the sheet path by the feed roller 12.

Desirably the bottom separation roller 20 provides a coefficient of friction with a sheet that is greater than a coefficient of friction between sheets so that it can separate two sheets, and the top separation roller 18 provides a coefficient of friction with a sheet that is greater than the coefficient of friction between the bottom roller 20 and a sheet so that the top roller 18 can urge a sheet forward even if only one sheet is between the rollers 18 and 20 and is being urged in both directions.

In the event the first multifeed check does not separate two sheets that have been compelled to the separation rollers 18 and 20, a second multifeed check returns both sheets toward the stack of sheets 14. When two sheets reach the sensor 22, the sensor indicates that more than one sheet is in the sheet path and provides signal(s) to disengage the top separation roller 18 from its motor 32 and to reverse the direction of rotation of the feed roller 12 so that both of the sheets between the separation rollers 18 and 20 are urged back to the stack of sheets 14.

The capstan roller 24 receives sheets from the separation roller 18 and conveys the sheets along the sheet path to an operating stage. Desirably the sheets are placed in correct registration before reaching the operating stage (for example, so that photosensitive materials are properly aligned before exposure). To this end, the capstan roller 24 may be placed so that a nip formed by the capstan roller is aligned with the operating stage. The capstan roller may form a nip across the surface of the sheets it receives, and may rotate slower than the separation rollers 18 and 20. By rotating slower, the capstan roller 24 forces sheets into better alignment. When a misaligned sheet is received at the capstan roller 24 one portion of the leading edge will enter the nip first. Because the separation rollers are rotating faster, the remainder of the leading edge will be forced forward more quickly than the portion caught by the nip of the capstan roller 24 thereby forcing it into better alignment.

Figure 2:
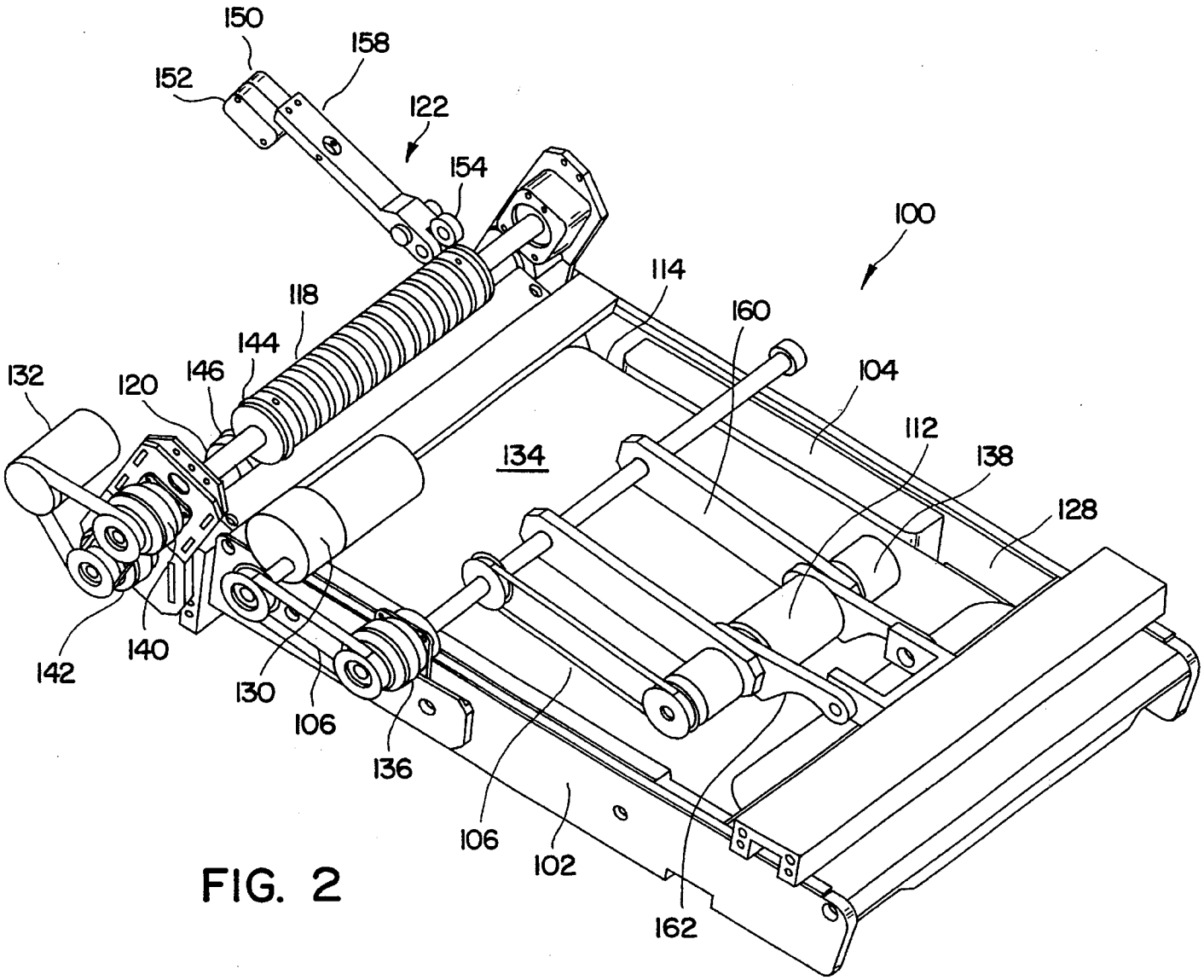
FIG. 2 is a pictorial depiction of a preferred embodiment of the sheet feeder disclosed herein.

With reference now to FIG. 2, a preferred embodiment 100 of the sheet feeder herein may include features corresponding to those discussed above, and the last two digits of the element numbers are indicative of that correspondence. A structural frame 102 may be provided to adapt the sheet feeder 100 to a particular application, and may be adapted to slidably receive a cassette 128 with the stack of sheets 114 therein. The sheets in the stack of sheets 114 may be held in proper alignment with a registration aide 104 that may apply pressure to the side of the stack of sheets 114. The registration aide 104 may be adjustable to adapt to sheets of diverse widths.

Feed roller 112 forms a nip with a top sheet 134 of the stack of sheets 114 to frictionally compel sheet 134 into a sheet path. Feed roller 112 may be rotated by a reversible DC gearmotor 130 through appropriate connections, such as the belts 106 shown. The gearmotor 130 may be selectively disengaged from the feed roller 112 by an electromechanical clutch 136. The feed roller 112 may pressurally engage the top sheet 134 to form the nip therewith and to this end may include one or more weights 138. The feed roller 112 and weights 138 may be pivotably attached to the structural frame 102 to allow the feed roller 112 to fall as the size of the stack of sheets 114 diminishes. Desirably the feed roller 112 extends at least about one-fourth the width of the sheet (e.g., two inches for an eight inch wide sheet), and may have a surface that is not likely to mar a sheet, such as polyurethane.

Sheets compelled into the sheet path by the feed roller 112 are routed between two separation rollers 118 and 120 that are rotated in the same direction by motor 132. The motor may operate in one direction and need not be stopped during normal operation. The separation rollers 118 and 120 may be disengaged from the motor 132 by electromechanical clutches 140 and 142. The separation roller 118 urges the sheets forward along the sheet path to a sensor 122 that determines whether more than one sheet has been urged. As discussed above, the top separation roller 118 urges the sheet in contact therewith forward along the sheet path, and the bottom separation roller 120 urges the sheet in contact therewith back to the stack of sheets 114.

Figure 3:
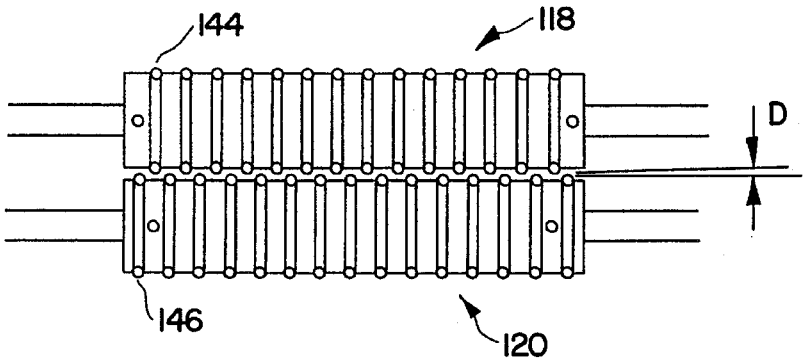
FIG. 3 is a pictorial depiction of an embodiment of the separation rollers disclosed herein.

With reference now to FIG. 3, the separation rollers 118 and 120 may each include a plurality of annular spaced-apart sheet contact surfaces 144 and 146 for contacting the sheet(s) between the separation rollers. The sheet contact surfaces 144 on roller 118 may be aligned with the spaces between the sheet contact surfaces 146 on roller 120 to thereby interleave the contact surfaces on the two rollers. Desirably the contact surfaces 144 do not touch contact surfaces 146.

Desirably the contact surfaces 146 on the bottom roller 120 provide a coefficient of friction with a sheet that is greater than a coefficient of friction between sheets so that it can separate two sheets. In a preferred embodiment that finds application for feeding sheets of photosensitive materials, the contact surfaces 146 are O-rings of silicone that may be carried in annular trenches in the roller 120. The silicone O-rings may have a Shore A hardness of 40 to 80 with 70 being preferred. The contact surfaces 144 of the top roller 118 provide a coefficient of friction with a sheet that is greater than the coefficient of friction between the contact surfaces 146 and a sheet so that the top roller 118 can urge a sheet forward even if only one sheet is between the rollers 118 and 120 and is being urged in both directions. In a preferred embodiment the contact surfaces 144 are O-rings of buna-N (nitrile). The buna-N O-rings may have a Shore A hardness of 40 to 90 with 70 being preferred. The O-rings discussed above are available from Apple Rubber Products of Lancaster N.Y. under the designations 70S (for the bottom roller) and 70BN (for the top roller).

The distance between the radially outward extent of the annular contact surfaces 144 and 146 may be set so that sheets between the rollers 118 and 120 are undulated (when viewed from the trailing or leading edges of the sheets). The forced undulation reduces the coefficient of friction so that the sheets may be more easily separated and improves the grip on the sheets. For example, the contact surfaces may overlap by a distance D less than the thickness of a sheet (preferably about one-half sheet thickness) while the contact surfaces on one roller may be spaced from a trough between contact surfaces on the other roller by more one sheet thickness.

Desirably, and to maintain better control of the sheets being urged forward, the sheet contact surfaces 144 and 146 are spaced across the width of the rollers 118 and 120 so that they contact sheets across a substantial portion of the width of the sheets (at least about two-thirds the sheet width being preferred). For example, the rollers 118 and 120 may have an axial length of about five and one-half inches for an eight inch wide sheet. The center-to-center spacing of the contact surfaces may vary, for example between about 0.2 and 0.6 inches, with 0.4 inches being preferred for thick, photosensitive media.

Figure 4:
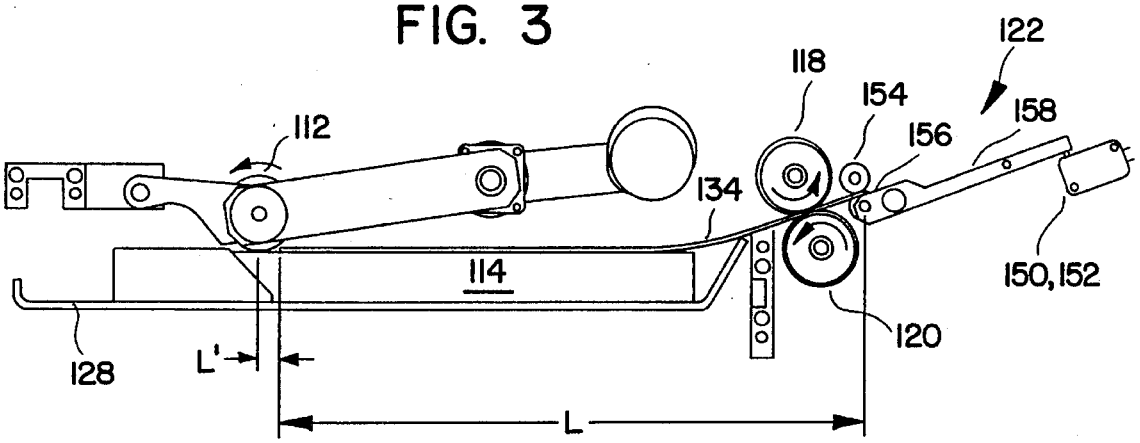
FIG. 4 is a pictorial depiction of a side view of the cassette and rollers of the embodiment of FIG. 2.

With reference now to FIG. 4, the sensor 122 may be placed to receive sheets urged forward by the separation roller 118. The sensor 122 may include two switches 150 and 152 (switch 152 being obscured in FIG. 4 and visible in FIG. 2) for sensing the number of sheets urged forward. Switch 150 may be activated when at least one sheet is urged forward, and switch 152 may be activated when more than one sheet is urged forward. Thus, two or more sheets are indicated by activation of both switches and one sheet is indicated by activation of only switch 150. This switch arrangement is compatible with the method of operating sheet feeder 100 (discussed below in relation to FIGS. 5*a*–5*g*), and other arrangements may be used. A sheet fed forward from the rollers 118 and 120 may be provided between two rolling bearings 154 and 156, with bearing 156 being adapted to move an arm 158 a distance corresponding to the combined thickness of the sheets between the bearings 154 and 156. When one sheet is between the bearings 154 and 156, the arm 158 is moved a distance sufficient to activate switch 150 (indicating at least one sheet), and when more than one sheet is between the bearings 154 and 156, the arm 158 is moved a distance sufficient to additionally activate switch 152 (indicating more than one sheet).

The sensor 122 is desirably spaced one sheet length L (measured along the curve) plus a small amount L' (e.g., a few mil) from the nip of the feed roller 112 to facilitate the operation of the sheet feeder discussed above. When one sheet 134 has been urged forward the sensor 122 provides a signal to stop rotation of the feed roller 112 so that further sheets are not urged forward (and disengaging roller 120 from motor 132 to facilitate forward movement of sheet 134.) In the event two shingled sheets are urged forward, the sensor would initially detect only a single sheet, and the transmission of signals to stop the feed roller is desirably deferred momentarily to allow time for a precautionary pull-back to return a second shingled sheet to the stack. The precautionary pull-back includes reversing the feed roller 112 and disengaging the lower separation roller 120 so that a second sheet shingled underneath sheet 134 will be urged back to the stack by the feed roller 112. The sensor 122 is thus desirably placed more than a distance L from the nip of the feed roller 112 so that the feed roller can be reversed to return the second sheet without effecting the top sheet 134. The precautionary pull-back may be made any time the sensor determines that at least one sheet has been urged forward (e.g., by activation of switch 150). In the event two paired sheets are urged forward (both switches 150 and 152 activated), the sensor 122 would indicate that the top roller 118 is to be disengaged to allow the bottom roller 120 to return the sheets to the stack and feed roller 112 may be reversed to facilitate this return.

In another embodiment, the sensor 22 may be light sensitive to measure the amount (or density) of light projected through the sheets. The light projected through one sheet will be different than the amount of light projected through two sheets and this difference may be measured with conventional light sensors. This embodiment may be appropriate for sheets through which a measurable amount of light may pass. The trailing edge detector 34 (FIG. 1) may be used as the sensor for measuring the light projected through the sheets. Alternatively, the sensor may be weight sensitive and use conventional weight detectors.

With reference again to FIG. 2, the cassette 128 may be inserted into the frame 102 to place the stack of sheets 114 under and in pressural engagement with the feed roller 112. When the cassette is being inserted it is desirable to lift the feed roller out of the way to avoid potential damage to the sheets, feed roller, and cassette. To his end, the feed roller 112 may be carried by a support 160 that includes a cam 162 for engaging the cassette 128 when the cassette is being inserted. The cam 162 pivotably moves the feed roller 112 and support 160 upwards while the cassette engages the cam 162, and thereafter allows the feed roller 112 to descend onto the stack of sheets 114.

Figure 5A:
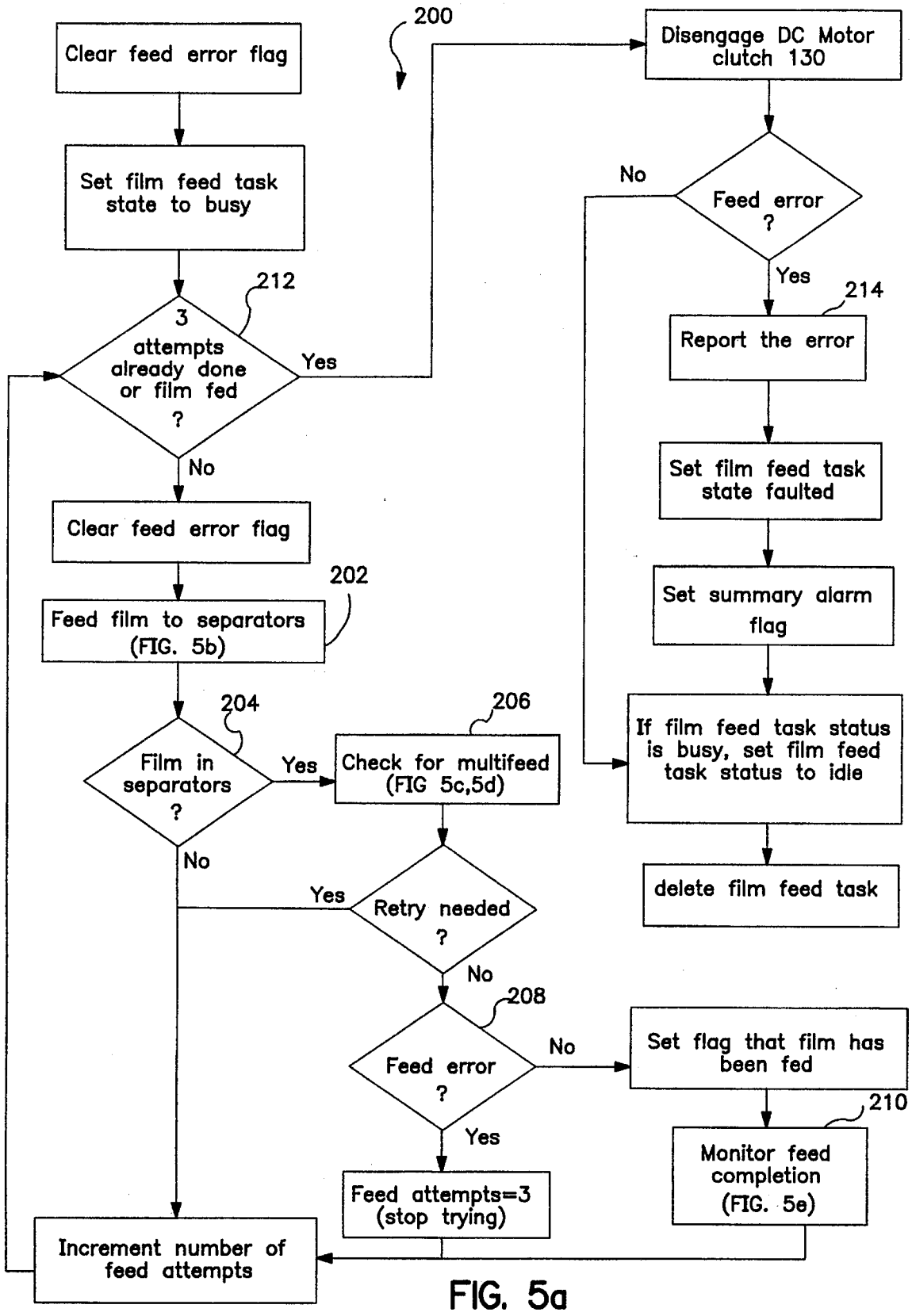
FIGS. 5*a*–5*g* are a flow diagram illustrating operation of an embodiment of the system disclosed herein.
Figure 5B:
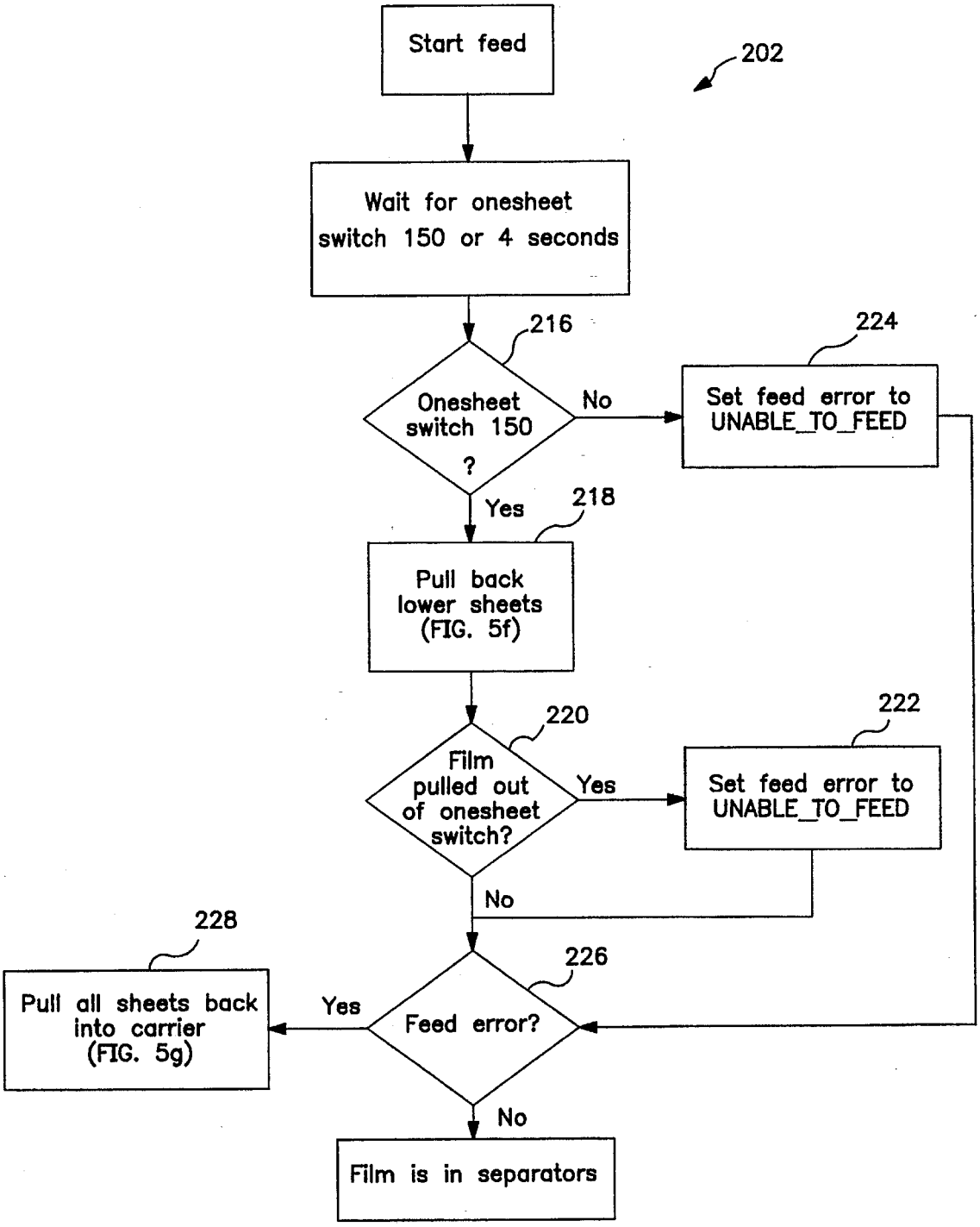

With reference now to FIGS. 5*a*–5*g*, the steps 200 of the operation of sheet feeder 100 may be more clearly seen (number elements inside the descriptive boxes relate to element numbers in FIG. 2). The steps set forth may be controlled by a conventional processor 36 (FIG. 1), or a processor configured for operation with the operating stage. FIG. 5*a* describes the main routine. Sheet feed 202 (for which see FIG. 5*b*) is initiated with the motor 132 for the separation rollers 118 and 120 turned on and clutches 140, 142, and 136 engaged. The feed roller motor 130 is on forward and sheets are compelled from the stack 114 into the sheet path. Sheets are urged along the sheet path by the rollers 118 and 120 and to sensor 122. If the sensor indicates 204 that at least one sheet has reached the separation rollers, a multifeed check 206 is performed (for which see FIGS. 5*c*, 5*d*). If the sensor indicates that a single sheet has been fed 208 (no feed error), completion of sheet feed is monitored 210 (for which see FIG. 5*e*). If a feed error has been detected, it is determined 212 whether a predetermined number of attempts (three in this embodiment) to feed a sheet have been made. If no more attempts are to be made, the appropriate indications may be made 214 to the operator through visual and/or sound signals.

Returning to step 202 (FIG. 5*b*), if an indication 216 (Yes) that at least one sheet has been urged forward is received within four seconds, normal operation continues. A precautionary pull-back is carried out in step 218 (for which see FIG. 5*f*). After the precautionary pull-back, the sensor is checked again in step 220 to be sure that at least one sheet is still present. If all sheets were pulled back in the precautionary pull-back (step 220-yes), an error is indicated in step 218 and a refeed is attempted.

If a onesheet switch indication is not received in four seconds 216 (no), it is presumed that no sheets have been compelled into the sheet path by feed roller 112 and that another attempt is to be made, and an error is indicated 224. A final feed error check is made 226, and if there has been a multifeed, all sheets are pulled back 228 (for which see FIG. 5*g*).

Figure 5C:
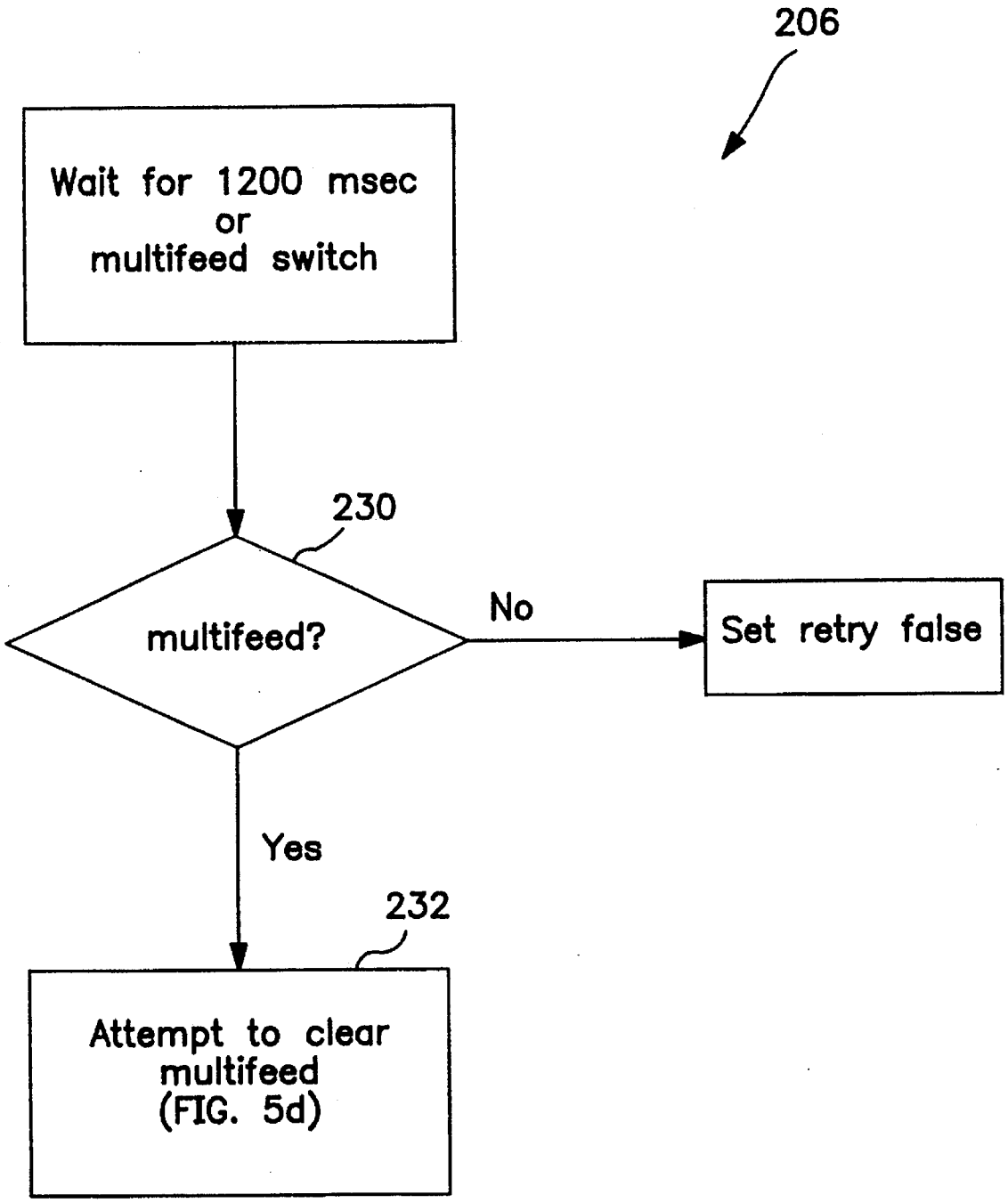
Figure 5D:
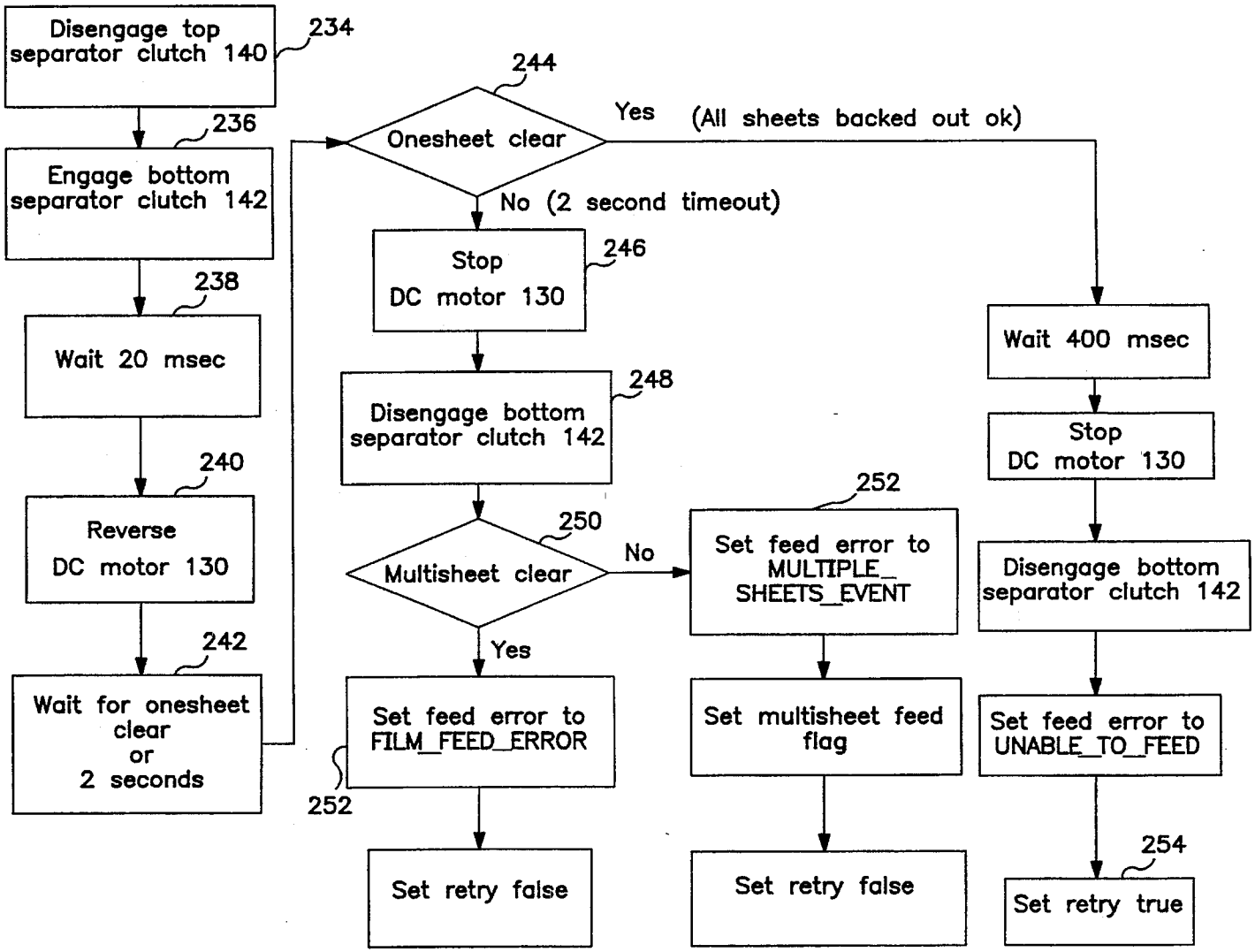

With reference now to the multifeed check of FIGS. 5*c* and 5*d*, if at least one sheet is present after the precautionary pull-back (in step 218), the second multifeed check is performed in step 206. If the sensor does not indicate that more than one sheet has been urged forward (step 230-no), that is, switch 152 has not been activated, system operation is presumed normal to this point and a refeed is not attempted. If the second multifeed check 206 indicates that more than one sheet has been urged forward (step 230-yes), a multifeed clear is attempted in step 232. A clear is attempted in steps 234–242. If the multifeed is not cleared (step 244-no), a roll forward is attempted 246–248 to send the multiple sheets forward. Regardless of whether the sheets are rolled forward 250 (yes) or not 250 (no), the feeder is presumed jammed and a retry is not attempted. Manual clearance may be required and appropriate signals (step 252) are provided to the operator. If the multifeed is cleared (step 244-yes, switches 150 and 152 deactivated), a retry may be attempted 254.

Figure 5E:
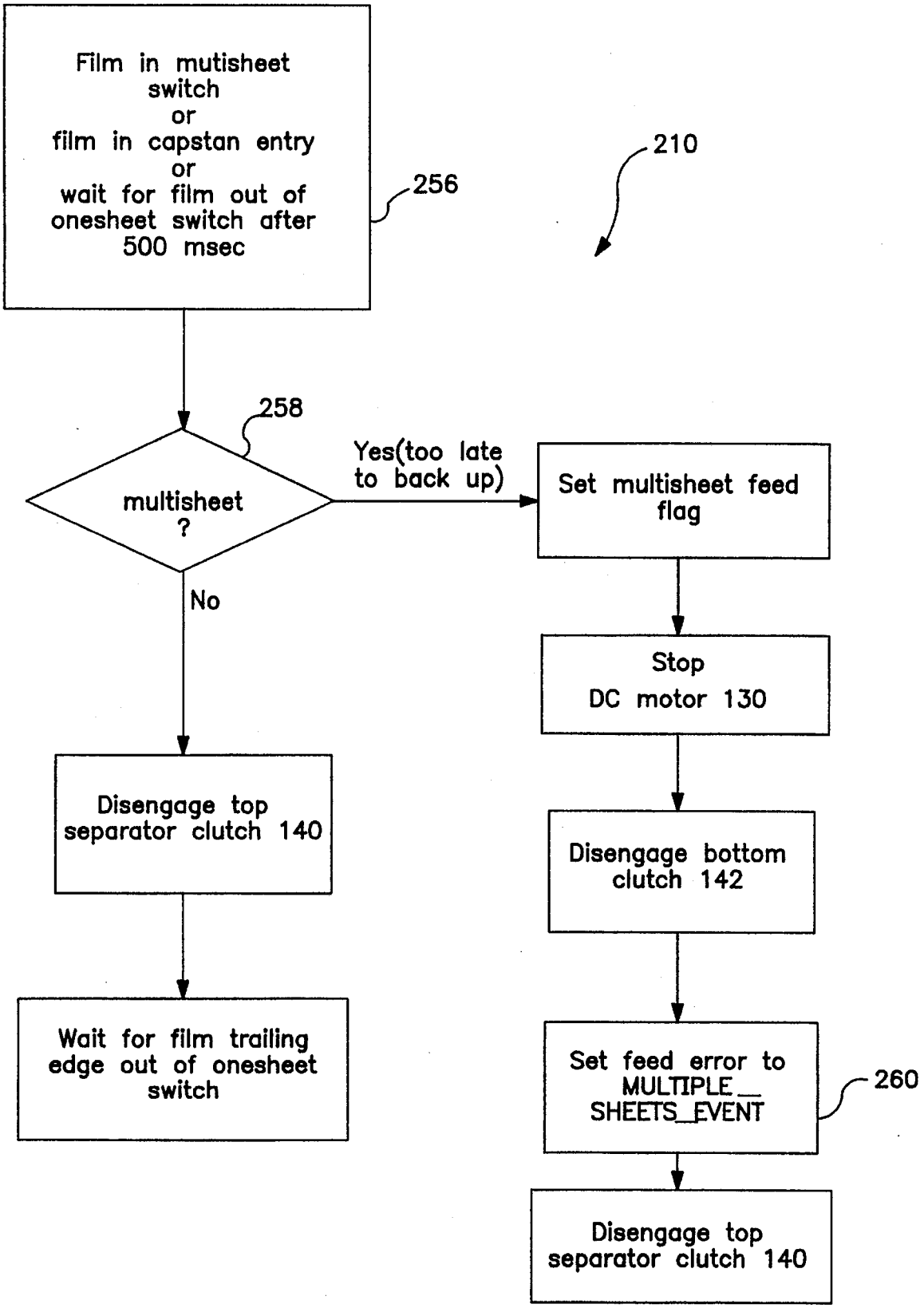
Figure 5F:
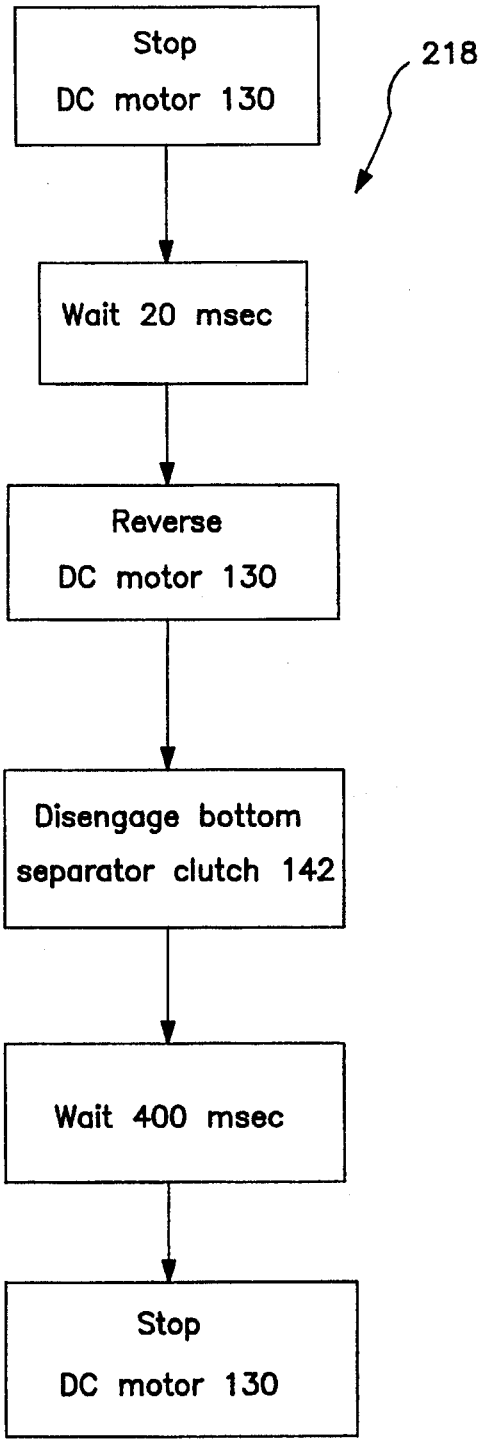
Figure 5G:
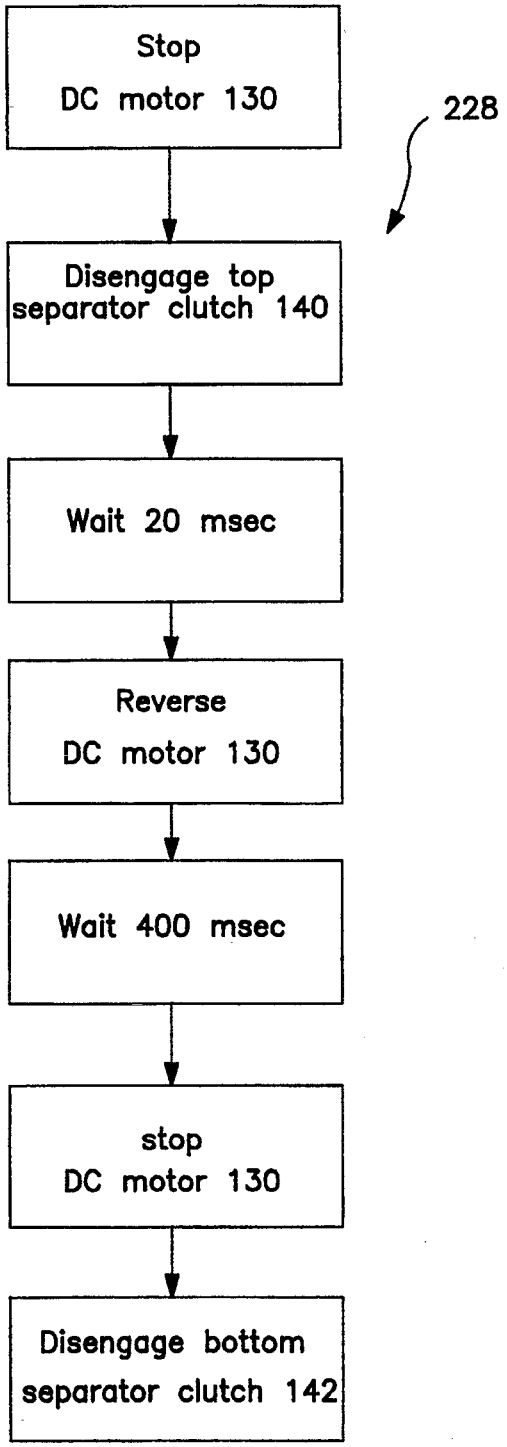

Completion of sheet feed is monitored in step 210 (FIG. 5*e*). As indicated therein, the sensor is monitored 256 until the sheet is beyond the sensors. If a multisheet indication (step 258-yes) is received now (such as when multiple sheets are rolled forward to clear a multifeed), it is too late to return the sheets to the stack and an error indication is provided 260. This indication may be used to alert the operating stage that two sheets are coming and that further operation may be aborted.

While preferred embodiments of the present invention have been described, it is to be understood that the embodiments described are illustrative only and the scope of the invention is to be defined solely by the appended claims when accorded a full range of equivalence, many variations and modifications naturally occurring to those of skill in the art from a perusal hereof.

What is claimed is:

1. A system for providing a sheet from a stack of sheets into a sheet path, said system comprising:

a feed roller for compelling sheets from the top of the stack of sheets into the sheet path between first and second rollers, said feed roller rotating forward to compel sheets into the sheet path, backward to return sheets to the stack of sheets, and not rotating to pressurally engage the stack of sheets;

first motor means for rotating said first and second rollers in the same direction to urge sheets from said feed roller forwardly along the sheet path, said first roller for urging a sheet in contact therewith forwardly along the sheet path, said second roller for urging a sheet in contact therewith backward to the stack of sheets;

clutch means for separately disengaging said first and second rollers from said first motor means; and control means for rotating said feed roller backwards and disengaging said second roller from said first motor means to return a sheet in contact with said feed roller to the top of the stack of sheets in the event more than one sheet is compelled into the sheet path by said feed roller, and for rotating said feed roller backwards and disengaging said first roller from said first motor means to return sheets in contact with said first and second rollers to the top of the stack of sheets in the event more than one sheet is urged along the sheet path by said first and second rollers.

2. The system of claim 1 further comprising sensor means for determining whether more than one sheet has been urged along the sheet path by said first and second rollers.

3. The system of claim 2 wherein said sensor means is spaced from said feed roller so that a sheet is free of said feed roller when reaching said sensor means.

4. The system of claim 2 wherein said sensor means comprises a thickness sensor for measuring a combined thickness of sheets urged along the sheet path to determine whether more than one sheet has been so urged.

5. The system of claim 4 wherein said thickness sensor comprises switch means for indicating whether at least one or more than one sheet has been urged along the sheet path by said first and second rollers, a moveable arm for operating said switch means, and spaced bearings for receiving therebetween sheets urged along the sheet path and for moving said arm responsive to the combined thickness of the sheets between said bearings.

6. The system of claim 5 wherein said switch means comprises two switches, a first switch for indicating that at least one sheet has been urged along the sheet path whereby said control means rotates said feed roller backwards and disengages said second roller from said first motor means, and a second switch for indicating that more than one sheet has been urged along the sheet path whereby said control means rotates said feed roller backwards and disengages said first roller from said first motor means.

7. A system for avoiding provision of multiple sheets from a stack of sheets to an imaging device, said system comprising:

a feed roller for compelling sheets from the stack of sheets into a sheet path;

first and second rollers for receiving sheets from said feed roller, said first roller for urging a sheet in contact therewith forwardly along the sheet path, said second roller for urging a sheet in contact therewith backward to the stack of sheets; and control means for rotating said feed roller backwards and for free wheeling said second roller to return a sheet in contact with said feed roller to the top of the stack of sheets in the event more than one sheet is compelled into the sheet path by said feed roller, and for rotating said feed roller backwards and for free wheeling said first roller to return sheets in contact with said first and second rollers to the top of the stack of sheets in the event more than one sheet is urged along the sheet path by said first and second rollers.

8. The system of claim 7 further comprising a first motor means for rotating said first and second rollers in the same direction, and clutch means for separately disengaging said first and second rollers from said first motor means.

9. The system of claim 7 wherein said feed roller comprises a weight for pressurally engaging the stack of sheets.

10. The system of claim 7 wherein said feed roller is pivoted to maintain pressural engagement with the stack of sheets.

11. The system of claim 7 further comprising a second motor means for selectively rotating said feed roller forward or backward, or not rotating said feed roller.

12. The system of claim 7 wherein said second roller provides a coefficient of friction with a sheet that is greater than a coefficient of friction between sheets, and said first roller provides a coefficient of friction with a sheet that is greater than the coefficient of friction between said second roller and a sheet.

13. The system of claim 7 further comprising a capstan roller for receiving a sheet urged along the sheet path by said first roller, said capstan roller rotating at a slower rate than said first roller whereby the sheet is urged into registration for the imaging device.

14. The system of claim 7 wherein the sheets in the stack of sheets are imaging receiving film sheets each about eight mils thick.

15. The system of claim 7 wherein the stack of sheets is provided in a cassette that is selectively inserted into said system, and wherein said feed roller comprises a cam engaged by said cassette for lifting said feed roller while said cassette is being inserted and for releasing said feed roller onto the stack of sheets after said cassette has been inserted.

16. The system of claim 15 wherein said cassette comprises means for pressurally engaging the stack of sheets at a side thereof to facilitate registration of the sheets.

17. The system of claim 7 further comprising a thickness sensor for measuring a combined thickness of sheets urged along the sheet path to determine whether more than one sheet has been so urged.

18. The system of claim 17 wherein said thickness sensor comprises two switches, a first switch for indicating that at least one sheet has been urged along the sheet path whereby said control means rotates said feed roller backwards and disengages said second roller from said first motor means, and a second switch for indicating that more than one sheet has been urged along the sheet path whereby said control means rotates said feed roller backwards and disengages said first roller from said first motor means.

19. The system of claim 18 wherein said thickness sensor further comprises a moveable arm for operating said two switches, and spaced bearings for receiving therebetween sheets urged along the sheet path and for moving said arm responsive to the combined thickness of the sheets between said bearings.

20. A method of providing single sheets from a stack of sheets to a sheet path, the method comprising the steps of:

(a) compelling a sheet from the top of the stack of sheets into the sheet path with a feed roller;

(b) rotating a pair of rollers in the same direction so that a first roller urges one sheet from the feed roller forward along the sheet path and so that a second roller urges a second sheet rearward to the stack of sheets in the event the feed roller has compelled more than one sheet into the sheet path;

(c) determining whether the pair of rollers has urged at least one sheet along the sheet path;

(d) allowing the second roller to rotate freely and reversing the feed roller in the event at least one sheet has been urged along the sheet path;

(e) determining whether the pair of rollers has urged more than one sheet along the sheet path; and (f) allowing the first roller to rotate freely and reversing the feed roller in the event it is determined that more than one sheet has been urged along the sheet path so that the second roller may urge the sheets back to the stack of sheets.

21. The method of claim 20 further comprising the step of measuring a combined thickness of sheets urged along the sheet path to determine if more than one sheet has been so urged.

22. The method of claim 21 further comprising the step of operating two switches with a moveable arm that is responsive to the measured combined thickness, a first switch for allowing the second roller to rotate freely and reversing the feed roller, and a second switch for allowing the first roller to rotate freely and reversing the feed roller.

23. In a sheet feeding system, a method of providing a sheet from a stack of sheets into a sheet path, the method comprising the steps of:

(a) using a feed roller to compel sheets from the top of the stack of sheets into the sheet path between first and second rollers;

(b) urging with the first roller a first sheet from the feed roller forwardly along the sheet path, while urging with the second roller a second sheet back to the stack Of sheets that may have been compelled into the sheet path with the first sheet;

(c) after the first sheet is free of the feed roller, reversing rotation of the feed roller and allowing the second roller to rotate freely to facilitate restacking the second sheet; and (d) reversing rotation of the feed roller and allowing the first roller to rotate freely to facilitate restacking the first and second sheet in the event the first and second sheets were urged along the sheet path.

24. The method of claim 23 further comprising the steps of (e) providing the stack of sheets to the feed roller in a cassette that may be selectively inserted into the sheet feeding system;

(f) lifting the feed roller with a cam while the cassette is being inserted so that the feed roller is not pressurally engaged with the stack of sheets; and (g) pressurally reengaging the feed roller with the stack of sheets after the cassette has been inserted.

25. The method of claim 23 further comprising the steps of rotating the first and second rollers in the same direction with a first motor means, and separately disengaging the first and second rollers from the first motor means to allow the first and second rollers to rotate freely.

26. The method of claim 23 further comprising the steps of providing the second roller with a coefficient of friction with a sheet that is greater than a coefficient of friction between sheets, and providing the first roller with a coefficient of friction with a sheet that is greater than the coefficient of friction between the second roller and a sheet.

27. The method of claim 23 further comprising the steps of providing a capstan roller for receiving a sheet urged along the sheet path by said first roller, and rotating the capstan roller at a slower rate than the first roller whereby the sheet is urged into registration.

28. The method of claim 23 wherein the sheets in the stack of sheets are imaging receiving film sheets each about eight mils thick.

29. The method of claim 23 further comprising the steps of projecting light through sheets urged along the sheet path, and determining the amount of light projected through the sheets to determine whether more than one sheet has been so urged.

30. The method of claim 23 further comprising the step of determining the weight of sheets urged along the sheet path to determine whether more than one sheet has been so urged.

31. The method of claim 23 further comprising the step of measuring a combined thickness of sheets urged along the sheet path to determine whether more than one sheet has been so urged.

32. The method of claim 31 further comprising the step of operating two switches with a moveable arm that is responsive to the measured combined thickness, a first switch for allowing the second roller to rotate freely and reversing the feed roller, and a second switch for allowing the first roller to rotate freely and reversing the feed roller.

* * * * *